US007876046B2

(12) United States Patent
Kweon

(10) Patent No.: US 7,876,046 B2
(45) Date of Patent: Jan. 25, 2011

(54) PLASMA DISPLAY PANEL

(75) Inventor: Tae-Joung Kweon, Suwon-si (KR)

(73) Assignee: Samsung SDI Co., Ltd., Yongin-si, Gyeonggi-do (KR)

( * ) Notice: Subject to any disclaimer, the term of this patent is extended or adjusted under 35 U.S.C. 154(b) by 102 days.

(21) Appl. No.: 12/314,990

(22) Filed: Dec. 19, 2008

(65) Prior Publication Data

US 2009/0179568 A1 Jul. 16, 2009

(30) Foreign Application Priority Data

Jan. 16, 2008 (KR) ..... 10-2008-0004910

(51) Int. Cl.
*H01J 17/49* (2006.01)

(52) U.S. Cl. ..... 313/582; 313/586

(58) Field of Classification Search ..... 313/582–587
See application file for complete search history.

(56) References Cited

U.S. PATENT DOCUMENTS

| | | | |
|---|---|---|---|
| 5,541,618 | A | 7/1996 | Shinoda |
| 5,661,500 | A | 8/1997 | Shinoda et al. |
| 5,663,741 | A | 9/1997 | Kanazawa |
| 5,674,553 | A | 10/1997 | Sinoda et al. |
| 5,724,054 | A | 3/1998 | Shinoda |
| 5,786,794 | A | 7/1998 | Kishi et al. |
| 5,952,782 | A | 9/1999 | Nanto |
| RE37,444 | E | 11/2001 | Kanazawa |
| 6,630,916 | B1 | 10/2003 | Shinoda |
| 6,707,436 | B2 | 3/2004 | Setoguchi et al. |
| 2008/0238320 | A1 | 10/2008 | Kweon |

FOREIGN PATENT DOCUMENTS

| | | |
|---|---|---|
| EP | 1017081 A2 | 7/2000 |
| JP | 2845183 | 10/1998 |
| JP | 2917279 | 4/1999 |
| JP | 2000-63152 | 2/2000 |
| JP | 2001-043804 | 2/2001 |
| JP | 2001-325888 | 11/2001 |
| JP | 2007-273485 | 10/2007 |

OTHER PUBLICATIONS

European Search Report issued by European Patent Office on Mar. 26, 2010 corresponding European Patent Application No. 091505610.

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Vip Patel
(74) *Attorney, Agent, or Firm*—Robert E. Bushnell, Esq.

(57) ABSTRACT

A lower dielectric layer which increases internal light reflectivity, and a plasma display panel (PDP) including the lower dielectric layer. The lower dielectric layer includes a white pigment of which concentration increases along a direction of light emitted outward from the inside of the PDP to effectively increase the internal light reflectivity.

11 Claims, 3 Drawing Sheets

PLASMA DISPLAY PANEL

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on Jan. 16, 2008 and there duly assigned Serial No. 10-2008-0004910.

BACKGROUND OF THE INVENTION

1. Field of the Invention

The present invention relates to a lower dielectric layer whose internal light reflectivity is significantly improved, and a plasma display panel including the same.

2. Description of the Related Art

Much research has been conducted to develop plasma display panels (PDPs) as one of next generation flat display panels with liquid crystal displays (LCDs), projection displays, and the like. PDPs are flat display panels characterized by a large-scale display structure and high image quality. Particularly, PDPs are self light emitting displays having excellent display properties comparable to a cathode ray tube (CRT), such as high brightness, high contrast, wide viewing angle, wide color reproduction range, and thin and large-scale display structure.

In a plasma display panel, ultraviolet rays are generated in vacuum from an inert gas excited by a high-frequency voltage and fluorescent materials are irradiated by the ultraviolet rays, thereby creating an image. Research on improving the bright room contrast has been conducted to further improve the image quality of the PDP.

Particularly, bright room contrast can be improved by increasing reflectivity by adding a white pigment to a lower dielectric layer. Here, a method of maximizing the reflectivity is required.

SUMMARY OF THE INVENTION

The present invention provides a lower dielectric layer for a plasma display panel (PDP) embedding an address electrode, the lower dielectric layer including: a glass component and a filler having a concentration gradient according to a height of the lower dielectric layer.

The present invention also provides a PDP including: a first substrate; and a lower dielectric layer, which is disposed on the first substrate and includes a glass component and a filler having a concentration gradient according to the height.

The present invention also provides a PDP including: an upper panel, which includes sustain electrodes disposed in a predetermined interval; an upper dielectric layer, which embeds the sustain electrodes; a lower panel, which faces the upper panel and includes address electrodes crossing the sustain electrode; a lower dielectric layer, which embeds the address electrodes; barrier ribs, which are formed between the upper and lower panels and partition discharge spaces; and a fluorescent layer, which is formed in each of the discharge spaces, wherein the lower dielectric layer includes a glass component and a filler having a concentration gradient according to the height.

According to an aspect of the present invention, there is provided a lower dielectric layer for a plasma display panel (PDP) embedding an address electrode, the lower dielectric layer including: a glass component and a filler having a concentration gradient according to a height of the lower dielectric layer.

The concentration of the filler may increase along a direction of light emitted outward from the inside of the PDP.

A transition point (Tg) and a softening point (Ts) of the filler may be higher than those of the glass component.

The filler may be a white filler.

The filler may be $TiO_2$, $WO_3$, $Al_2O_3$, ZnO, or a mixture thereof.

The concentration of the glass component may decrease along a direction of light emitted outward from the inside of the PDP.

The glass component may be $SiO_2$, ZnO, $Bi_2O_3$, PbO, $B_2O_3$, $Al_2O_3$, ZnO, or thereof.

According to another aspect of the present invention, there is provided a PDP including: a first substrate; and a lower dielectric layer, which is disposed on the first substrate and includes a glass component and a filler having a concentration gradient according to the height.

The concentration of the filler may increase along a direction of light emitted outward from the inside of the PDP.

The concentration of the glass component may decrease along a direction of light emitted outward from the inside of the PDP.

According to another aspect of the present invention, there is provided a PDP including: an upper panel, which includes sustain electrodes disposed in a predetermined interval; an upper dielectric layer, which embeds the sustain electrodes; a lower panel, which faces the upper panel and includes address electrodes crossing the sustain electrode; a lower dielectric layer, which embeds the address electrodes; barrier ribs, which are formed between the upper and lower panels and partition discharge spaces; and a fluorescent layer, which is formed in each of the discharge spaces, wherein the lower dielectric layer includes a glass component and a filler having a concentration gradient according to the height.

The concentration of the filler may increase along a direction of light emitted outward from the inside of the PDP.

The concentration of the glass component may decrease along a direction of light emitted outward from the inside of the PDP.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Hereinafter, the present invention will be described more fully with reference to the accompanying drawings, in which exemplary embodiments of the invention are shown.

Figure 1:
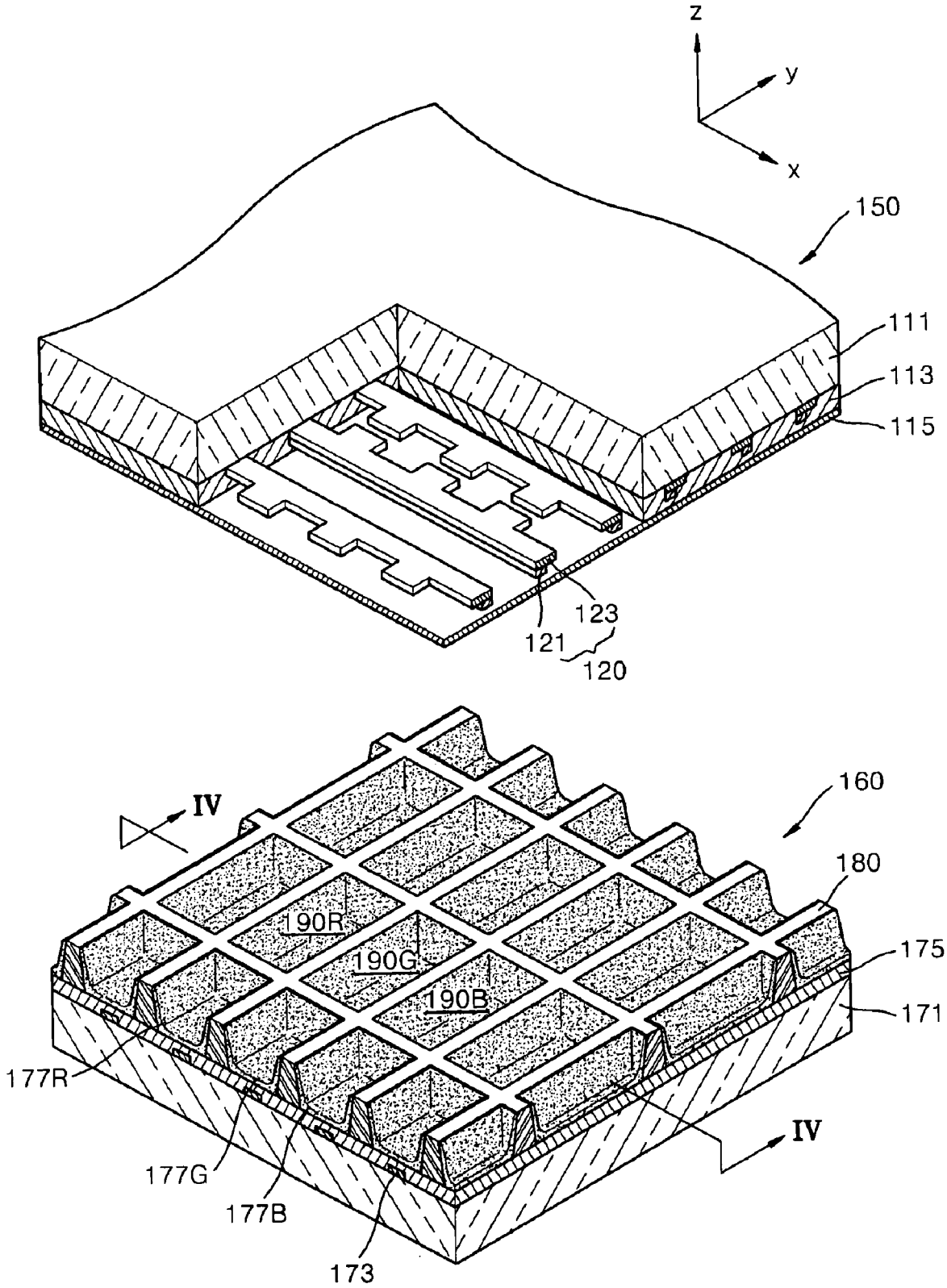
FIG. 1 is an exploded perspective view of a plasma display panel (PDP) according to an embodiment of the present invention.
Figure 2:
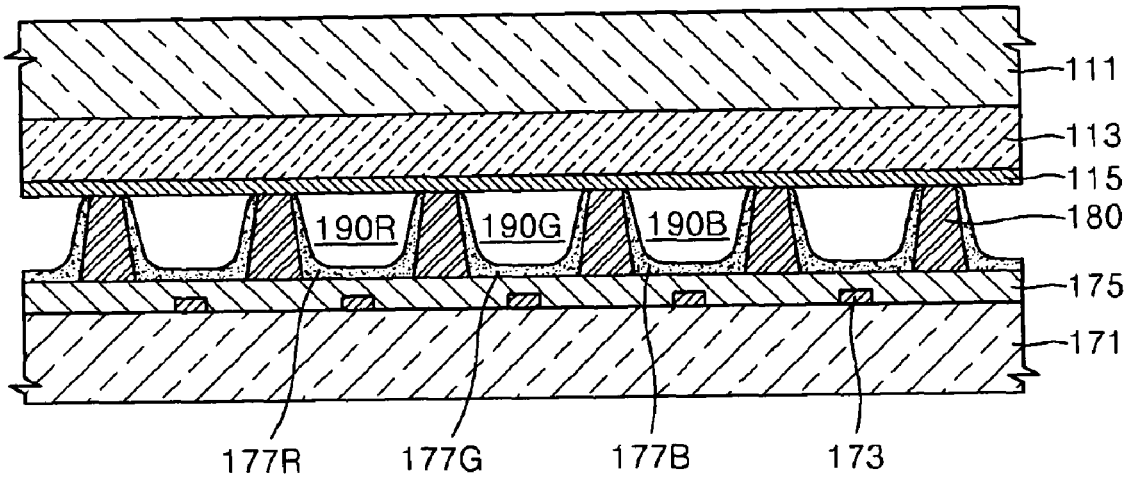
FIG. 2 is a cross sectional view of a PDP according to an embodiment of the present invention.

FIG. 1 is an exploded perspective view of a plasma display panel (PDP) according to an embodiment of the present invention, whose lower dielectric layer contains a white filler 185 according to a predetermined concentration gradient, and FIG. 2 is a cross sectional view of the PDP. The PDP according to the current embodiment of the present invention includes an upper panel 150 and a lower panel 160, which are connected to each other and then sealed. The upper panel 150 and the lower panel 160 are illustrated separately for convenience of describing the internal structure of the PDP.

Referring to FIGS. 1 and 2, the upper panel 150 includes a plurality of sustain discharge electrodes 120 that extends in an X direction on a first substrate 111, and a first dielectric layer 113 is formed to embed the sustain discharge electrodes 120. Also, a protective layer 115 is disposed on the first dielectric layer 113.

The first substrate 111 may be formed of a soda lime glass having excellent light permeability. Also, the first substrate 111 may be colored in order to reduce external light reflection, and thus improve bright room contrast.

The sustain discharge electrodes 120, which are disposed parallel to each other along the X direction on the first substrate 111, include an X electrode and Y electrode which respectively include a bus electrode 121 and a transparent electrode 123.

The bus electrode 121 compensates for a relatively large resistance value of the transparent electrode 123 so that a nearly uniform voltage can be applied to a plurality of discharge cells. The bus electrode 121 may be formed of chrome (Cr), copper (Cu), aluminum (Al), or the like.

The transparent electrode 123 generates and sustains discharge, and may be formed of a material having high visible light transmissivity and low electrode resistance, such as indium tin oxide.

In the first dielectric layer 113, a discharge current is restricted so as to sustain a glow discharge, and a memory function and voltage are reduced via wall charge accumulation. In order to increase discharge efficiency, a withstand voltage and visible light transmissivity may be high.

The protective layer 115 is formed of a material that has excellent plasma resistance to protect the first dielectric layer 113 and the sustain discharge electrode 120 from collisions with charged particles and has high secondary electron emission coefficient to reduce power consumption by lowering a voltage required to initiate a discharge and a voltage required to sustain the discharge. Further, when the light is emitted through the first substrate 111, the material should not interfere with transmission of visible light generated by fluorescent substances due to its high light transmissivity. Magnesium oxide (MgO) may be used as the protective layer, and magnesium oxide (MgO) doped with other elements may be used as desired.

The lower panel 160 facing the upper panel 150 includes a plurality of address electrodes 173 that extend in a Y direction on a second substrate 171, and a second dielectric layer 175 embedding the address electrodes 173. Barrier ribs 180 forming a plurality of discharge cells having rectangular cross-sections are disposed on the second dielectric layer 175 and fluorescent layers are disposed inside the discharge cells.

As the first substrate 111, the second substrate 171 may be formed of a soda lime glass having excellent light permeability. In addition, the second substrate 171 may be colored in order to reduce external light reflection, and thus to improve bright room contrast.

The address electrodes 173 are disposed parallel to each other along the Y direction on the second substrate 171. The address electrode 173 may also be formed of a conductive material such as chrome (Cr), aluminum (Al), or the like so that a nearly uniform voltage can be applied to a plurality of discharge cells, as for the bus electrode 121.

The second dielectric layer 175 protects the address electrode 173 from collisions with charged particles. In the second dielectric layer 175, a discharge current is restricted so as to sustain a glow discharge, and a memory function and a voltage are reduced due to wall charge accumulation.

The barrier ribs 180 are formed on the second dielectric layer 175 and partition a discharge space formed between the first substrate 111 and the second substrate 171 in a plurality of discharge cells. The barrier ribs 180 have a matrix-type structure in the current embodiment of the present invention. However, the present invention is not limited thereto, and the barrier ribs 180 may have a stripe-type structure or be formed in such a way that cross-sections of the discharge cells have various shapes such as a circular shape and a polygonal shape.

A fluorescent layer is disposed in each of the discharge cells. In order to realize full-color displays, the fluorescent layer includes various colors. For example, when a color image is realized using the three-primary colors of light, a red fluorescent layer 177R, a green fluorescent layer 177G, and a blue fluorescent layer 177B are alternately coated in the discharge cells to form a red discharge cell 190R, a green discharge cell 190G, and a blue discharge cell 190B.

The second dielectric layer 175 includes a glass component and a filler 185 in such a way that the concentration of the filler 185 increases along a direction of light emitted outward from the inside of the PDP. When light is emitted through the first substrate 111, the concentration of the filler 185 increases along a Z direction.

The filler 185 may be a white filler, which has higher transition point (Tg) and softening point (Ts) than the glass component. The white filler may not be totally white.

In the current embodiment, the filler 185 is $TiO_2$, but the filler 185 may be $WO_3$, $Al_2O_3$, ZnO, or a mixture thereof.

Also, the second dielectric layer 175 includes the glass component formed by mixing ZnO and $Bi_2O_3$. Alternatively, the glass component may be PbO, i.e. a material containing lead, a lead free material, or a mixture of a material containing lead and a lead free material. The concentration of the glass component in the second dielectric layer 175 decreases along the Z direction.

Figure 3:
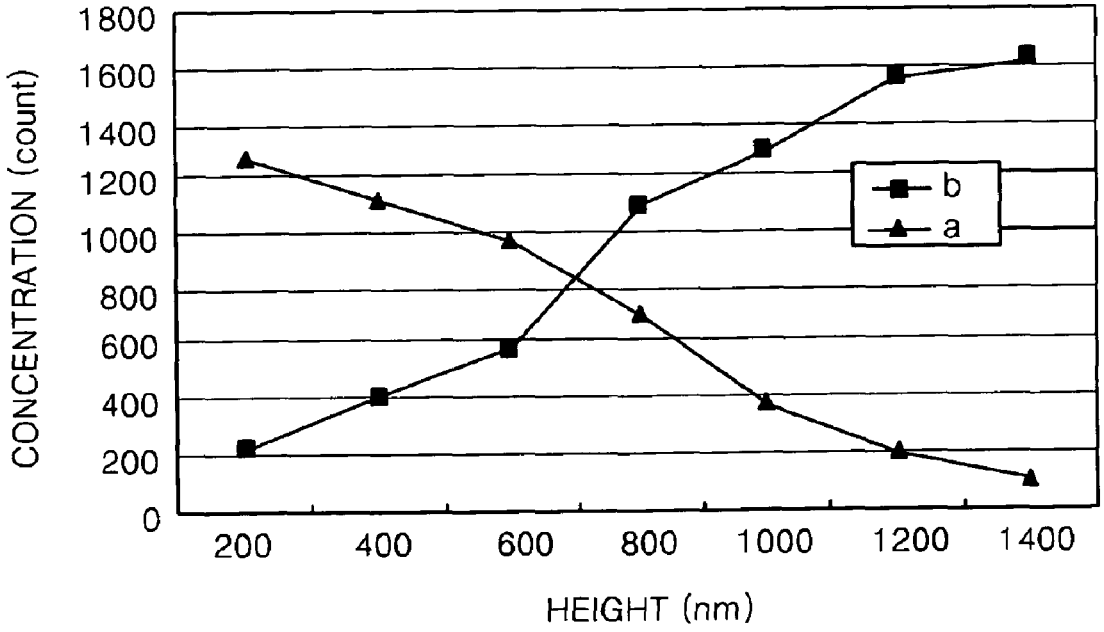
FIG. 3 is a graph illustrating concentrations of a filler and a glass component according to a height of a lower dielectric layer in a PDP according to an embodiment of the present invention.

Table 1 below shows the result of analyzing a concentration gradient of the filler 185 and the glass component according to the height of the second dielectric layer 175, and FIG. 3 is a graph illustrating such result.

TABLE 1

| Height of Second Dielectric Layer | Glass Component (Count) | Filler Components (Count) |
|---|---|---|
| 200 | 213 | 1283 |
| 400 | 411 | 1124 |
| 600 | 575 | 981 |
| 800 | 1101 | 702 |
| 1000 | 1302 | 387 |
| 1200 | 1560 | 198 |
| 1400 | 1621 | 102 |

Referring to Table 1 and FIG. 3, as the height, i.e. the Z direction, of the second dielectric layer 175 is low, the number of filler components (a) increases and the number of glass components (b) decreases.

The second dielectric layer 175 including the filler 185 and the glass component according to such concentration gradient can be manufactured as follows.

First, glass component powder and pigment component powder are mixed, and then a paste is produced by mixing the mixture of the glass component powder and pigment component powder, a binder, and an organic solvent. The paste is coated on a substrate, and the paste is sintered so as to form the second dielectric layer 175. The contents of the glass component powder, the pigment component powder, the binder, and the organic solvent in the paste are according to contents of a conventional dielectric paste composition. The sintering may be carried out in approximately between 540 and 590° C. for 1 to 3 hours. Via such sintering process, the glass component having relatively low transition point (Tg) and softening point (Ts) is sintered first, and thus a filler component having relatively high transition point (Tg) and softening point (Ts) is present in high concentration at the upper part of the second dielectric layer 175. Accordingly at the upper part of the second dielectric layer of the present invention, a white filler is distributed in high concentration compared to a conventional technology, in which the distribution of a white filter is uniform. As a result, a second dielectric layer of the present invention can excellently reflect a visible light emitted from a discharge cell, and thus brightness is increased. Consequently contrast of a PDP is improved.

Figure 4:
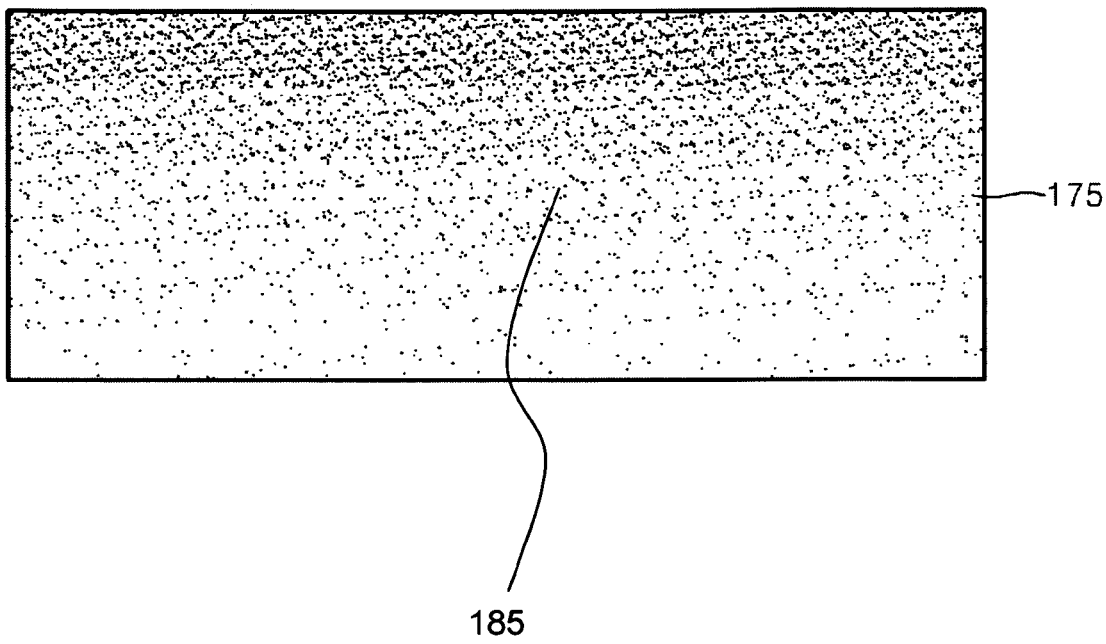
FIG. 4 is a cross sectional view of the filler according to an embodiment of the present invention.

FIG. 4 is a cross sectional view of the second dielectric layer 175 and the filler 185 in which the filler 185 increases in concentration along the direction of light emitted outward from the inside of the PDP.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A lower dielectric layer for a plasma display panel (PDP) embedding an address electrode, the lower dielectric layer comprising:

a glass component and a filler having a concentration gradient that varies within the lower dielectric layer, wherein the concentration of the filler increases along a direction of light emitted outward from the inside of the PDP.

2. The lower dielectric layer of claim 1, wherein a transition point (Tg) and a softening point (Ts) of the filler are higher than those of the glass component.

3. The lower dielectric layer of claim 1, wherein the filler is a white filler.

4. The lower dielectric layer of claim 1, wherein the filler is $TiO_2$, $WO_3$, $Al_2O_3$, ZnO, or a mixture thereof.

5. The lower dielectric layer of claim 1, wherein the concentration of the glass component decreases along a direction of light emitted outward from the inside of the PDP.

6. The lower dielectric layer of claim 1, wherein the glass component is $SiO_2$, ZnO, $Bi_2O_3$, PbO, $B_2O_3$, $Al_2O_3$, ZnO, or a mixture thereof.

7. A plasma display panel (PDP), comprising:

a first substrate; and a lower dielectric layer, which is disposed on the first substrate and includes a glass component and a filler having a concentration gradient that varies within said lower dielectric layer, wherein the concentration of the filler increases along a direction of light emitted outward from the inside of the PDP.

8. The PDP of claim 7, wherein the concentration of the glass component decreases along a direction of light emitted outward from the inside of the PDP.

9. A plasma display panel (PDP), comprising:

an upper panel, which includes sustain electrodes disposed in a predetermined interval;

an upper dielectric layer, which embeds the sustain electrodes;

a lower panel, which faces the upper panel and includes address electrodes crossing the sustain electrode;

a lower dielectric layer, which embeds the address electrodes;

barrier ribs, which are formed between the upper and lower panels and partition discharge spaces; and a fluorescent layer, which is formed in each of the discharge spaces, wherein the lower dielectric layer includes a glass component and a filler having a concentration gradient that varies within said lower dielectric layer, wherein the concentration of the filler increases along a direction of light emitted outward from the inside of the PDP.

10. The PDP of claim 9, wherein the concentration of the glass component decreases along a direction of light emitted outward from the inside of the PDP.

11. A plasma display panel having a substrate, comprising:

a lower dielectric layer, which is disposed on said substrate and includes a glass component, wherein said lower dielectric layer contains a filler having a white pigment which has a higher transition point and a softening point than said glass component, wherein a concentration of said filler increases along a direction of light emitted outward from said plasma display increasing internal light reflectivity of the plasma display panel.

* * * * *